United States Patent [19]

Gresh

[11] Patent Number: 5,064,056

[45] Date of Patent: Nov. 12, 1991

[54] PACKAGING SYSTEM

[75] Inventor: Timothy F. Gresh, Winsted, Conn.

[73] Assignee: Harrow Products, Inc., Mich.

[21] Appl. No.: 563,040

[22] Filed: Aug. 3, 1990

[51] Int. Cl.[5] ..... B65D 75/02; B65D 85/00

[52] U.S. Cl. ..... 206/45.19; 206/470; 206/471; 206/45.31; 206/485; 206/321

[58] Field of Search ..... 206/471, 470, 468, 467, 206/464, 463, 462, 461, 477, 495, 321, 485, 45.14, 45.19, 45.31

[56] References Cited

U.S. PATENT DOCUMENTS

| | | | |
|---|---|---|---|
| 1,569,679 | 1/1926 | Sanborn | 206/321 |
| 2,979,192 | 4/1961 | Blonder | 206/321 |
| 3,108,685 | 10/1963 | DeVines | 206/45.33 |
| 3,185,296 | 5/1965 | Schlage | 206/45.31 X |
| 3,326,362 | 6/1967 | Smith et al. | 206/321 |
| 3,463,309 | 8/1969 | Szostek | 206/470 |
| 3,666,087 | 5/1972 | Cooper | 206/45.34 X |
| 3,880,283 | 4/1975 | Flaherty et al. | 206/45.19 X |
| 4,016,972 | 4/1977 | Szamborski | 206/471 X |
| 4,069,915 | 1/1978 | Schurman | 206/305 |
| 4,199,058 | 4/1980 | Lense et al. | 206/45.14 |
| 4,307,803 | 12/1981 | Johnson | 206/45.19 |
| 4,724,964 | 2/1988 | Hernandez | 206/470 X |
| 4,807,747 | 2/1989 | Hadtke | 206/471 X |
| 4,899,877 | 2/1990 | Kiernam | 206/471 X |
| 4,930,627 | 6/1990 | Borst et al. | 206/470 X |

*Primary Examiner*—Paul T. Sewell
*Assistant Examiner*—Jacob K. Ackun, Jr.
*Attorney, Agent, or Firm*—Robert H. Montgomery

[57] ABSTRACT

A packaging system for an item of hardware comprising a bottom member of transparent molded plastic having a generally rectangular ridge defined thereon, a cover member having a hollow interior and top wall and side walls having a bottom flange adapted to fit over and be secured to the ridge on the bottom member, the cover member being of transparent molded plastic, a support member adapted to fit on the bottom member within the defined ridge, the support member having means defined therein for receiving an item of hardware, a securing member adapted to be fitted to the support member to secure the item of hardware therebetween, the support member and the securing member having a combined dimension in the direction of the distance between the top wall of the cover member and the bottom member which is substantially the same as the distance between the top wall of the cover member and the bottom member.

20 Claims, 3 Drawing Sheets

PACKAGING SYSTEM

FIELD OF THE INVENTION

This invention relates to a packaging system for displaying articles of hardware, as for example, items of hardware which may be referred to as a door set or a lock set and which will advantageously display the lockset while providing concealed space for items of hardware which are necessary for mounting the lockset.

BACKGROUND OF THE INVENTION

Items of hardware are in many instances displayed in see through containers made of a plastic material to attempt to most advantageously display an article offered for sale. Moreover, such containers or packages are generally arranged to be hung on hooks or other extensions from a peg board or other type of merchandising display units.

Various types of display or containers for locksets have previously been proposed. Examples are U.S. Pat. No. 2,979,192, U.S. Pat. No. 3,108,685, U.S. Pat. No. 3,185,296 and U.S. Pat. No. 3,326,362. However, these various packages do not completely show the entire product or to advantageously display the unit.

U.S. Pat. No. 4,307,803 does disclose a display structure for a lockset but does not really provide sufficient support for the lockset in the package, or provision for hanging display thereof.

Accordingly, the present invention provides a new and improved display packaging primarily for a lockset, but the features thereof may be used in other packaging systems.

SUMMARY OF THE INVENTION

Briefly stated the invention in one form thereof comprises a packaging system for an item of hardware comprising a bottom member of transparent molded plastic having a generally rectangular ridge defined thereon, a cover member having a hollow interior and top wall and side walls having a bottom flange adapted to fit over and be secured to said ridge, said cover member being of transparent molded plastic, a support member adapted to fit on said bottom member within said ridge, said support member having means defined therein for receiving an item of hardware thereon, a securing member adapted to be fitted to said support member to secure the item of hardware therebetween, said support member and said securing member having a combined dimension in the direction of the distance between the top wall of said cover member and said bottom member which is substantially or essentially the same as the distance between said top wall and said bottom member.

An object of this invention is to provide a new and improved display system for items of hardware.

Another object of this invention is to provide a new and improved packaging system for items of hardware which advantageously display a hardware item while securely mounting the item therein.

The features of the invention which are believed to be novel are particularly pointed out and distinctly claimed in the concluding portion of this specification. The invention, however, together with further objects and advantages thereof may best be appreciated by reference to the following detailed description taken in conjunction with the drawings.

DETAILED DESCRIPTION OF PREFERRED EMBODIMENT OF THE INVENTION

Figure 1:
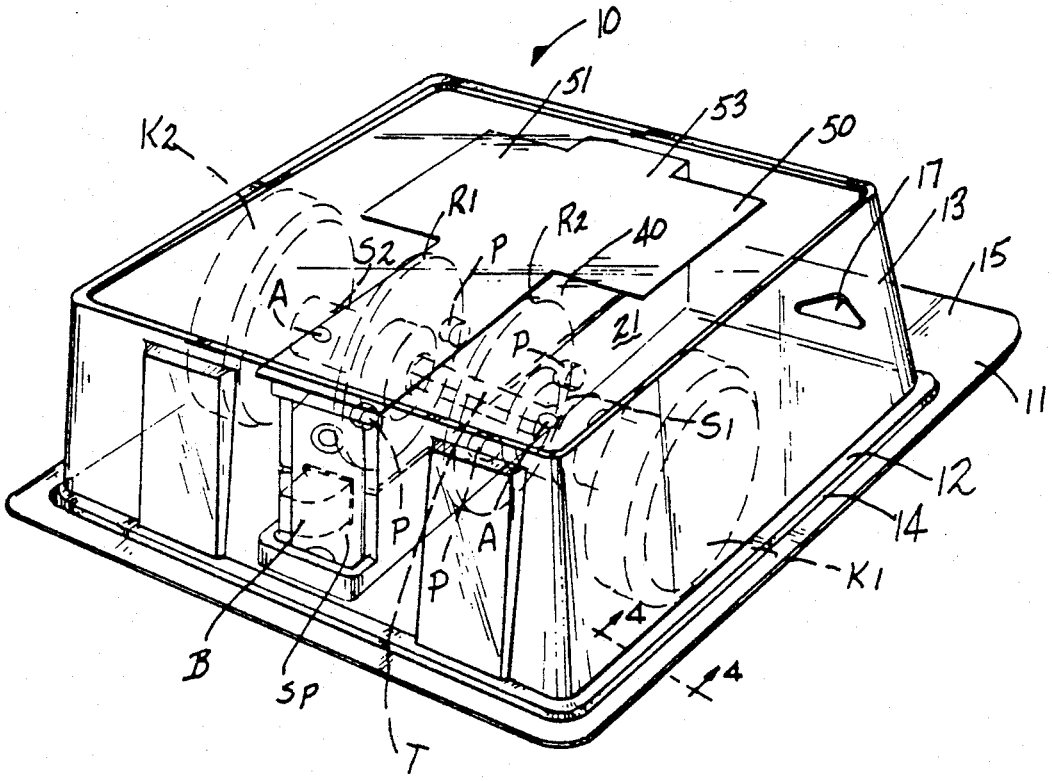
FIG. 1 is a perspective view of a packaging system embodying the invention with a door set therein.

As shown in FIG. 1, a packaging system is designed to house and display what may be referred to as a lockset or a doorset to open a door for entry into a room.

As used herein the term "lockset" or "doorset" refers to an entry way permissive device which would comprise two knobs or levers, or combination of either on both sides of a door adapted to retract a bolt which normally extends into a strike plate and maintain the door in a closed position without actuation of any knobs or levers.

The doorset typically comprises a pair of knobs K1 and K2, or, alternatively, could be levers. Each of the knobs has a shank S1 and S2 respectfully, which threadably receive a shaft T extending through a latch case, not shown. The shaft which is generally square will actuate or retract a latch bolt B extending from the latch case.

To prepare a door for installation of a knob set, a tool or jig is used to align apertures through the door for shaft or spindle T with an opening through the vertical non-hinged end of the door for passage of the latch case LC. The latch case has either an integral or attached flange which overlies the opening through the edge of the door. Alternatively, this alignment may be accomplished by careful measurement or use of a template with properly dimensioned tools.

A faceplate (not shown) is affixed to the free edge of the door and secures the flange SP of the latch case in the door.

A door strike (not shown) is secured to the jamb of the door with a suitable opening therethrough to receive the latch bolt.

To aesthetically cover the openings through the door for the shaft and latch case a pair of roses R1 and R2 are provided. Each of the roses R1 and R2 include a pair of internally threaded posts P. Screws (not shown) are provided to threadably extend through apertures A in rose R2 and posts thereon (not shown) into the posts P in Rose R1. These screws further support the doorset on the door.

Threaded apertures A, usually two, are defined in shanks S1 and S2 to receive set screws which bear on flats of shaft T to lock the knobs on shaft T.

It maybe seen that loose pieces of hardware, namely set screws, faceplate and door strike must be provided with a door set for installation thereof.

As previously stated, the above described doorset is typical of those presently available. The present invention provides a new and improved packaging system for a door set, and also provides convenient, unobtrusive compartments for loose hardware and mounting instructions.

A lockset as described is adapted to be received and displayed within a packaging system 10 embodying the invention. The packaging system includes a base or bottom member 11 of generally rectangular form having a rectangular ridge 12 defined thereon. The system further includes a cover member 13 of generally parallelepiped form having at the bottom thereof a rectangular flange 14 defining a recess for receiving ridge 12. The flange 14 fits over ridge 12 as hereinafter described and permits the cover member 13 to be located on the bottom member 11. An adhesive or radio frequency weld may be applied between ridge 12 and flange 13. The adhesive or weld would be of a type which would prohibit separation of the cover member from the base member while exposed to the strenuous forces of shipping. The base member as hereinafter described has apertures 17 in an extension 15 thereof, to receive hooks so the packaging system with the lockset therein can be hung from a suitable display board.

Figure 2:
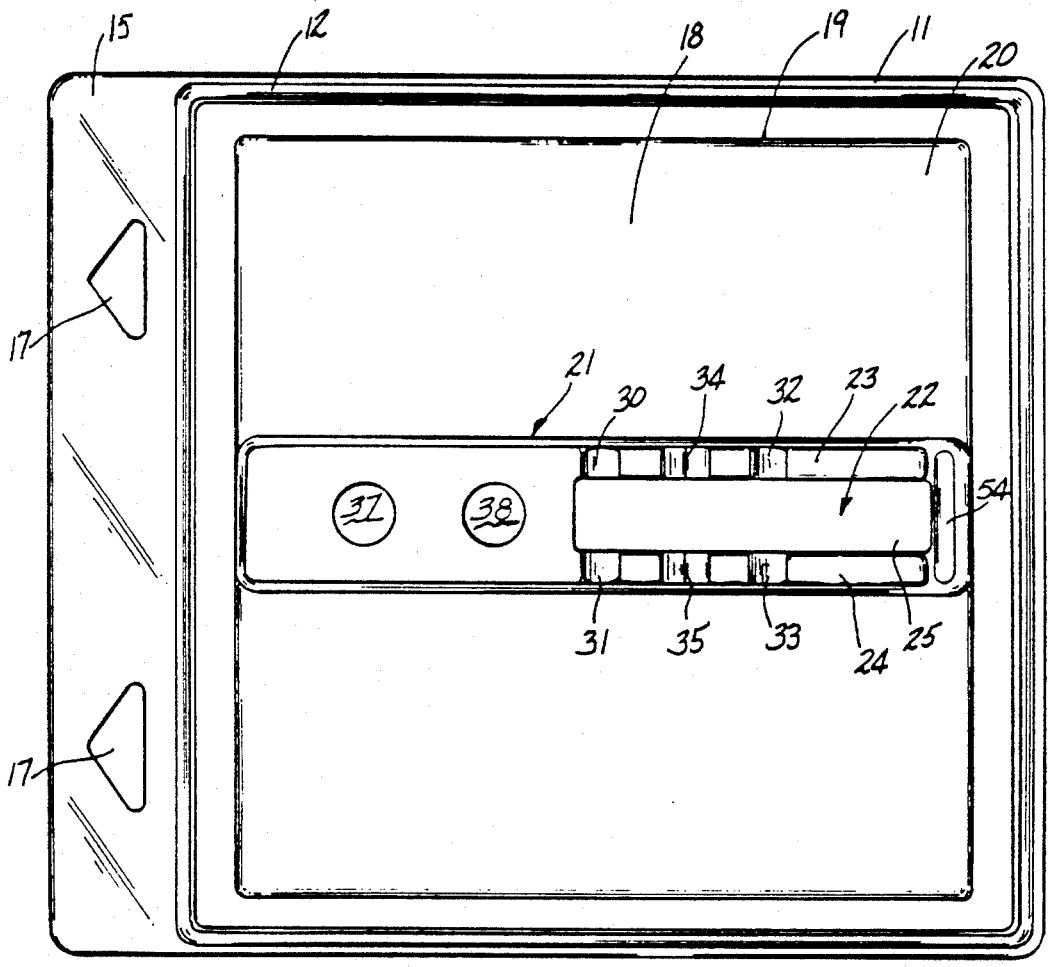
FIG. 2 is a top view of the packaging system of FIG. 1 showing a knobset supporting member with the cover and a retaining member removed.

Reference is now made to FIG. 2 which is a plan view of the base member 11 with the cover member 13 removed. FIG. 2 also exemplifies the apertures 17 in extension 15 of base member 11.

Figure 3:
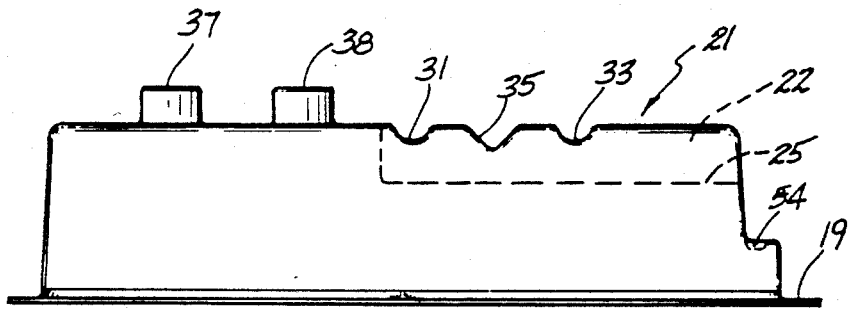
FIG. 3 is a side view of the system of FIG. 2 seen from the lower side (FIG. 2) thereof.

Disposed within and positioned by ridge 12 of base member 11 is an interior or support member 18 having a flange 19 thereabout including a slightly elevated portion 20. Member 18 has a support portion 21 thereon which is also shown in elevation in FIG. 3. The support portion 21 is formed integrally with member 18 which is of a molded plastic, as for example styrene. The support portion 21 is hollow and provides a recess 22 therein adapted to receive the latch case. Support portion 21 has side walls 23 and 24 partially defining recess 22. Recess 22 is also defined by a bottom wall 25.

Defined in each of side walls 23 and 24 are substantially semi-circular recesses 30 and 31, respectively, which are aligned and recesses 32 and 33 which are also aligned. Further defined immediate the aforementioned recesses are V-shaped recesses 34 and 35 on side walls 23 and 24, respectively.

The recesses 30–33 will receive the posts P extending the roses R1 and R2 therein. The recesses 34 and 35 will receive the shaft T therein.

Projecting upwardly from support portion 21 to the left of recess 22, as shown, are pair of annular extensions or buttons 37 and 38 for purposes hereinafter described.

The flange 19 on interior member 18 provides a spacing 39 (FIG. 4) between member 18 and bottom member 11 which may be utilized to store a card describing the lockset and the specifications thereof and also permit insertions of installation instructions, templates, et. Moreover, the hollow interior of member 21 permits storage of attachment or installation hardware.

Figure 5:
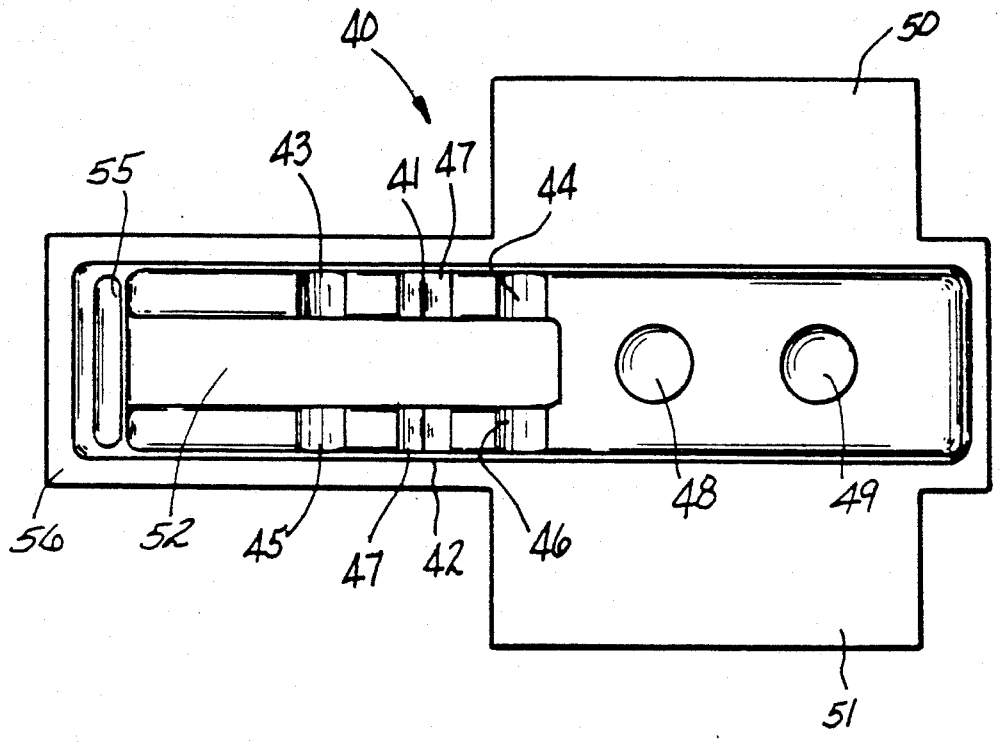
FIG. 5. is a view seen from below a doorset securing member which fits over the supporting member shown in FIGS. 2 and 3.
Figure 6:
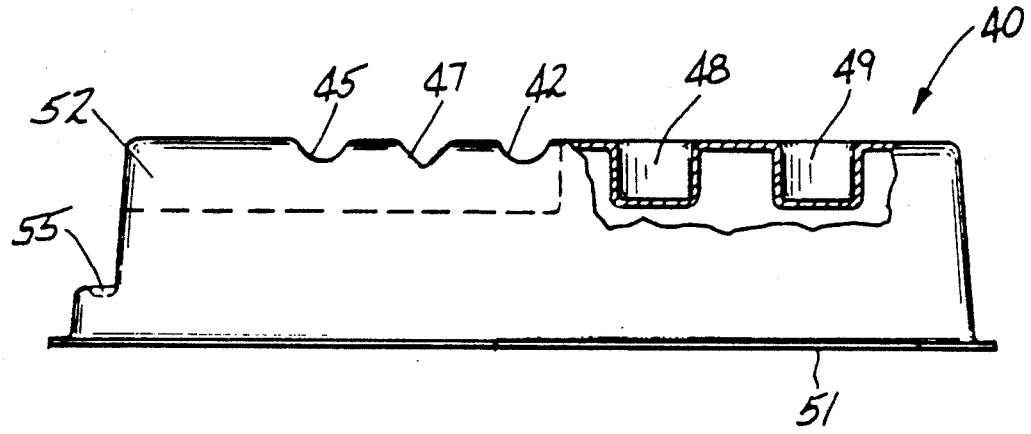
FIG. 6 is a side view of the retaining member of FIG. 4 seen from the lower side thereof.

Reference is now made to FIGS. 5 and 6. FIG. 5 exemplifies a securing member 40 adapted to fit over support portion 21 and secure a lock set or door set between the support portion and the securing member. The securing member 40 is also of a molded plastic construction and as shown in FIG. 5 defines substantially semi-annular recesses 43 and 44 in side wall 41 and semi-annular recess 45 and 46 in side wall 42. The recesses 43 and 45 are aligned as are the recesses 44 and 46. Intermediate the recesses in each aforementioned is a V-shaped recess 47 in side wall 41 and also in side wall 42.

The purposes of the recesses 43, 45 and the recesses 44, 46 are to receive the posts P of the roses R1 and R2 therein while the V-shaped recess 47 receives the shaft T therein.

Member 40 further has defined therein sockets 48 and 49 which frictionally receive the extensions 37 and 38 on member 21 and tend to lock the securing member 40 to support member 21 to secure the lock set therein.

The interior of member 40 is hollow as indicated by the reference numberal 52 and may be provided with integral winglike pieces 50 and 51 which provide surfaces on the side opposite to that shown in FIG. 5 for the adhesion of a card 53 bearing or other indicia, a description of the goods or other identifying information such as "Solid Brass" or other designation of material. This may be appreciated from the view of member 40 as shown in FIG. 1. Member 40 is also hollow and may store securing or installation hardware under the card 53 in recess 22 and across wings 50 and 51. The combined vertical dimension of members 40 and 21 are such that the surrounding flange 56 and wings 50 and 51 will substantially bear on the top of cover member 13. The flange 56 and wings 50 and 51 are continuous.

Figure 4:
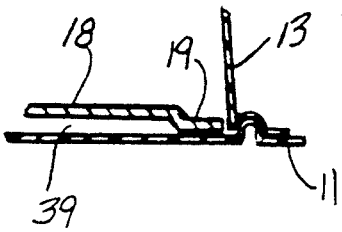
FIG. 4 is a sectional view seen in the plane of lines 4–4 of FIG. 1.

Reference is now made to FIG. 4 which is a section seen in the plane of lines 4—4 of FIG. 1 to illustrate organization of base member 11, cover 13 member and interior member 18 and further exemplifying the space 39 between bottom member 11 and interior member 18 to receive any printed literature therein.

From the foregoing description, it may be seen that a lock set or other items of hardware may be securely supported between the bottom member 11 and the cover member 13 while effectively and advantageously displaying the hardware item.

The members 18; including support portion 21 is and preferably covered with a flocking material of suitable color which will advantageously provide a background and display for the packaged item of hardware.

The support portion and the securing member may take various forms dependent on the item to be displayed.

The recess 22 in support portion 21 and the recess 52 in securing member 40 may conveniently take any form to receive an item of hardware therein.

It may thus be seen that the objects of the invention set forth, as well as those made apparent from the foregoing description, are efficiently attained. While a preferred embodiment of the invention has been set forth for purposes of disclosure, modification to the disclosed embodiment of the invention, as well as other embodiments thereof, may occur to those skilled in the art. Accordingly, the appended claims are intended to cover all embodiments of the invention and modifications to the disclosed embodiment which do not depart from the spirit and scope of the invention.

What is claimed is:

1. A packaging system for an item to be displayed comprising a bottom member of molded plastic having a generally rectangular ridge defined thereon, a cover member having a hollow interior, a top wall and side walls having a bottom flange adapted to fit over and be secured to said ridge, said cover member being of transparent molded plastic, an interior member having a generally rectangular peripheral flange and an elevated support portion adapted to receive thereon the item to be displayed, said periphery dimensioned to fit within said ridge and position said interior member within the ridge on said bottom member, a securing member adapted to be fitted to said support portion to secure the item to be displayed therebetween, said support portion and said securing member having a combined dimension in the direction of the distance between the top wall of said cover member and said bottom member which is substantially the same as the distance between said top wall and said bottom member.

2. The system of claim 1 wherein said support portion and said securing member have cooperating means thereon for securing one to the other.

3. The system of claim 2 wherein said cooperative means comprises extending buttons on one of said support portion and securing member and rockets on the other of said members dimensioned to frictionally receive said buttons.

4. The system of claim 1 designed to receive and support a doorset having spaced apart roses thereon and a shaft extending therethrough, the roses having inwardly directed posts thereon, and said support portion and said securing member have recesses thereon for capturing the shaft and the posts.

5. The system of claim 1 wherein at least one of said support portion and said securing member are hollow.

6. The system of claim 1 wherein said interior member has a slightly elevated interior portion within said peripheral flange which spaces said interior member above said bottom member and defines a space between said interior member and said bottom member.

7. The system of claim 1 in which said bottom member on one side thereof has an extension with apertures therein to receive hanging support means therethrough.

8. The system of claim 1 wherein said support portion has a hollow portion therein.

9. The system of claim 1 wherein said securing member has a hollow portion defined therein.

10. The system of claim 1 wherein said support portion and said securing member both have hollow portions defined therein.

11. A packaging system for an item to be displayed comprising a bottom member of molded plastic having a generally rectangular ridge defined thereon, a cover member having a hollow interior, a top wall and side walls having a bottom flange with a recess therein adapted to fit over said ridge, said cover member being of transparent molded plastic, an interior member having a generally rectangular peripheral flange and an elevated support portion adapted to receive thereon the item to be displayed, said periphery dimensioned to fit within said ridge and position said interior member within the ridge on said bottom member a securing member adapted to be fitted to said support portion to secure the item to be displayed therebetween, at least one of said support portion and said securing member having means defined therein for receiving an item to be displayed said support portion and said securing member having a combined dimension in the direction of the distance between the top wall of said cover member and said bottom member which is substantially the same as the distance between said top wall and said bottom member.

12. The system of claim 1 wherein said support portion and said securing member have cooperating means thereon for securing one to the other.

13. The system of claim 12 wherein said cooperating means comprises extending buttons on one of said support portion and securing member and sockets on the other of said members dimensioned to frictionally receive said buttons.

14. The system of claim 11 designed to receive and support a doorset having spaced apart roses thereon and a shaft extending therethrough, the roses having inwardly directed posts thereon, and said means defined in said at least one of said support portion and said securing member comprises recesses in both of said support portion and said securing member for capturing the shaft and the posts.

15. The system of claim 11 wherein at least one of said support portion and said securing member are hollow.

16. The system of claim 11 wherein said interior member has an elevated portion within said ridge which defines a space between said interior member and said bottom member.

17. The system of claim 11 in which said bottom member on one side thereof has an extension with apertures therein to receive hanging support means therethrough.

18. The system of claim 11 wherein said support portion is hollow.

19. The system of claim 11 wherein said securing member is hollow.

20. The system of claim 11 wherein said support portion and said securing member both have hollow portions defined therein.

* * * * *

UNITED STATES PATENT AND TRADEMARK OFFICE

CERTIFICATE OF CORRECTION

PATENT NO. : 5,064,056

DATED : November 12, 1991

INVENTOR(S) : Timothy F. Gresh

It is certified that error appears in the above-identified patent and that said Letters Patent is hereby corrected as shown below:

Column 4, line 10 "numberal" should read --numeral--.

Signed and Sealed this

Twenty-third Day of March, 1993

*Attest:*

STEPHEN G. KUNIN

*Attesting Officer*

*Acting Commissioner of Patents and Trademarks*